United States Patent [19]

Fogaras

[11] 3,984,617

[45] Oct. 5, 1976

[54] ELECTRIC ARC FURNACE

[75] Inventor: Laszlo Fogaras, Vasteras, Sweden

[73] Assignee: Allmanna Svenska Elektriska Aktiebolaget, Vasteras, Sweden

[22] Filed: Sept. 17, 1975

[21] Appl. No.: 614,167

[30] Foreign Application Priority Data

Mar. 10, 1974 Sweden ..... 7412453

[52] U.S. Cl. ..... 13/35

[51] Int. Cl.[2] ..... F27D 1/60

[58] Field of Search ..... 13/9, 35; 335/296, 297

[56] References Cited

UNITED STATES PATENTS

| | | | |
|---|---|---|---|
| 3,619,467 | 11/1971 | Goodman | 13/35 |
| 3,883,677 | 5/1975 | Hanas et al. | 13/35 |
| 3,885,082 | 5/1975 | Hanas | 13/35 |

*Primary Examiner*—R. N. Envall, Jr.
*Attorney, Agent, or Firm*—Kenyon & Kenyon Reilly Carr & Chapin

[57] ABSTRACT

An electric arc furnace has its side wall lining protected against arc-flare by an external magnet forming a magnetic flux field on the inside of the lining where arc-flare protection is required, and a supply of ferromagnetic particles are fed downwardly through this flux field for the purpose of forming a layer of the particles held against the lining. The particles are continuously fed to replace particles which, because of heating, become non-magnetic and fall. In this case, the magnet is an electromagnet having an iron core and solenoid windings which produce a more uniformly and widely spread layer of the particles on the sidewall lining's inside.

5 Claims, 7 Drawing Figures

ELECTRIC ARC FURNACE

BACKGROUND OF THE INVENTION

An electric arc furnace comprises a vessel having a refractory lining for containing a metal charge, and at least one arcing electrode extending down into the vessel with its bottom tip spaced above the charge to form an electrically powered arc which produces an arc flare which radiates against the refractory lining of the side wall of the vessel, causing premature erosion of the lining.

To shield the lining from the arc-flare, the U.S. Goodman Pat. No. 3,619,467, dated Nov. 9, 1971, discloses the use of an electromagnet on the outside of the lining and forming a flux field on the inside of the lining where the lining is normally exposed to the arc-flare. A flow of ferromagnetic particles is fed downwardly through this flux field so that the particles adhere to the lining and form a protective layer, the particles being held until, through heating, they become non-magnetic and fall, the feed of particles providing for their replacement and maintenance of the layer of protective particles. The electromagnet construction proposed has an iron core forming vertically interspaced pole pieces on which solenoid coils are coiled.

The effectiveness of the above proposal depends on the intensity of the flux field that can be created on the inside of the lining. To increase the strength of this flux field, the U.S. Hanas et al. U.S. Pat. No. 3,883,677, dated May 13, 1975, discloses an arc furnace construction wherein the furnace lining has its outer surface provided with a recess reducing the thickness of the lining so that the spacing between the external magnet and the lining's inside is reduced, means between the magnet and the recess for water-cooling the lining of reduced thickness being provided. In this case the magnet is also an electromagnet having vertically interspaced pole pieces on which solenoid coils are coiled.

Both patented furnaces involve a problem in that the layer of particles held on the inside of the furnace lining, is restricted as to its extent and is non-uniform in thickness, so that the protection provided by the layer of particles, is not as effective as is desirable.

SUMMARY OF THE INVENTION

The object of the present invention is to solve the above problem as completely as possible.

For that purpose the present invention is an improvement on the patented arrangements, the magnet being an electromagnet comprising an upstanding yoke from which at least three pole pieces extend towards the furnace vessel side wall portion to be protected against the arc-flare, the pole pieces being interspaced one above the other and forming upper, lower and interposed pole pieces, a first solenoid coil coiled around the upper pole piece and a second solenoid coil coiled around the yoke between the interposed and lower pole pieces. The core is made of iron and the solenoid coils are, of course, electrically powered, normally using direct current.

In this way the flux field on the inside of the lining is made more uniform from its top to its bottom, the strength of the flux field being substantially equally strong throughout its extent, thus resulting in a more uniform layer of the electromagnet particles being held on the inside of the lining. With this core and solenoid coil arrangement, it becomes possible to extend the height of the layer of particles, by positioning a second electromagnet having an upstanding yoke and two vertically interspaced pole pieces of which the uppermost one is positioned adjacent the lower pole piece of the first magnet. With a solenoid coil coiled around the yoke, a number of magnets of this second type can be extended below the first magnet, to extend the height of the flux field on the inside of the furnace lining, to form an extended flux field of substantially uniform intensity or strength throughout, this, of course, providing for an extending layer of particles of substantially uniform thickness.

In many cases, an electric arc furnace uses more than one arcing electrode, each producing an arc-flare, and the magnet arrangement described can be used in conjunction with appropriate feeds of the electromagnetic particles at each and every location where the lining protection is advisable.

BRIEF DESCRIPTION OF THE DRAWINGS

The principles of the present invention are illustrated schematically by the accompanying drawings, in which.

DETAILED DESCRIPTION OF THE INVENTION

Figure 2:
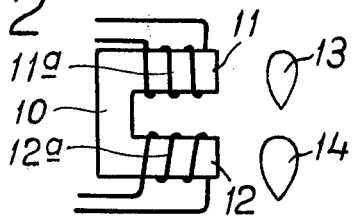
FIGS. 2 and 3 are, in each instance, schematic representations of electromagnets having constructions apparently obviously making them adaptable for use in the case of a furnace of the type previously described.

Having reference to the above drawings, FIG. 2 shows an electromagnet formed by an iron core comprising a yoke 10 and two pole pieces 11 and 12 which, in the case of the patented constructions, would extend towards the outside of the furnace lining portion to be protected against the arc-flare. Each pole piece carries a solenoid coil as shown at **11*a* and 12*a*, and it is to be assumed that the coils are powered by direct current. In other words, this is a typical electromagnet used successfully for many applications. However, when used as the magnet required by the patented furnaces, the result is localized in one or two accumulations, indicated at 13 and 14, of teardrop shape formed because of the cooperation between the attraction of the magnetic flux magnetized beyond the two pole pieces, and gravity. To increase the magnetic flux field obtainable with such a magnet, its core size must be increased, resulting in increasing the vertical interspacing between the pole pieces 11 and 12**, easily resulting in a very substantial loss in the strength of the flux field between the pole pieces, thus resulting in a dead zone where the particles either do not accumulate at all or form a layer of such thinness as to be of negligible value as protection against the arc-flare.

Another type of electromagnet commonly used for various applications, has an iron core having three pole pieces 15, 16 and 17 extending from a yoke 18, the middle or interposed pole piece 16 carrying the solenoid coil 19. When used in connection with the patented furnace constructions, the field strength of the flux field opposite the top and bottom pole pieces 15 and 17, is extremely weak and results in the formation of no accumulations at 20 and 21, whereas in front of the interposed pole 16 a stronger field is obtained but with the result of a localized accumulation of the particles shown at 22, again of teardrop shape for the reason explained before.

Figure 3:
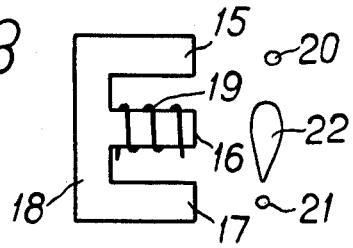
Figure 4:
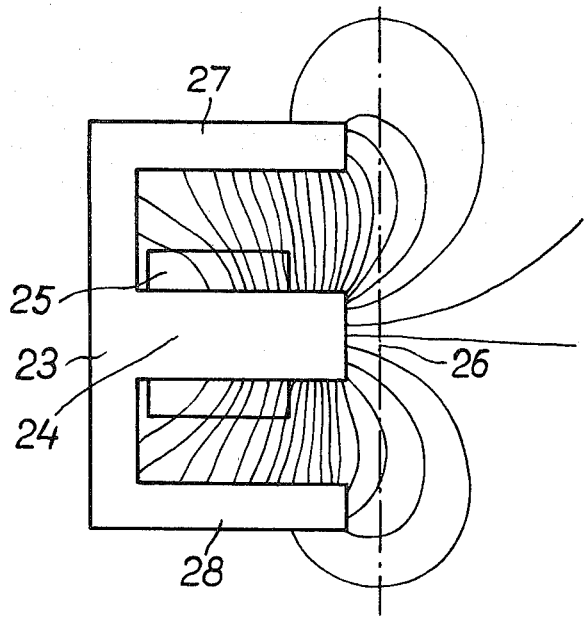
FIG. 4 schematically illustrates the flux field obtained with, for example, the FIG. 3 arrangement.

The reason for uneven layers being obtained on the inside of the furnace lining with such conventional electromagnet constructions, is indicated by FIG. 4 where the iron core is formed by a vertical yoke 23 from which a central pole piece 24 extends and to which the solenoid coil 25 is applied, the furnace lining inside being indicated by the broken line 26 and the core having upper and lower pole pieces 27 and 28, respectively. From this it can be seen that the flux field obtained on the inside of the furnace lining is strong opposite the pole piece 24 but relatively weak at the outer pole pieces 27 and 28. This results in the accumulations indicated by FIG. 3.

Through these FIGS. 2, 3 and 4, the problem confronting the patented furnace constructions has been explained. It appears that this problem was not heretofore anticipated.

Figure 1:
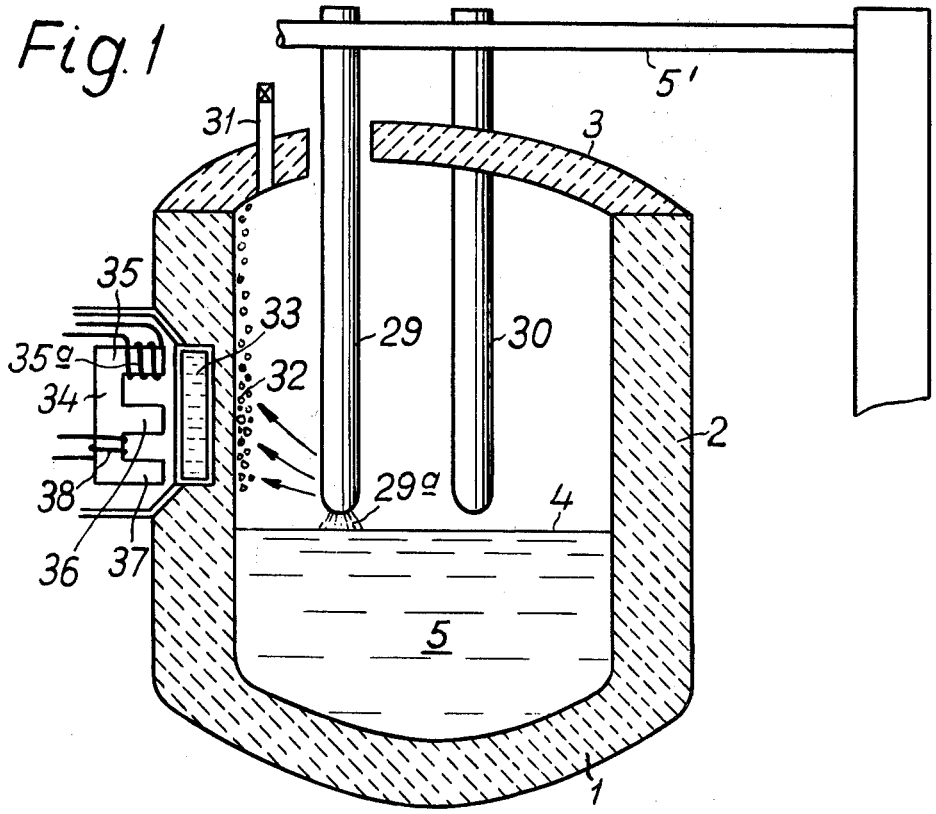
FIG. 1 is a vertical section showing an electric arc furnace to which the invention is applied.

Now, having reference to FIG. 1, in vertical cross section a furnace of the patented type disclosed by the Hanas et al. patent, is shown schematically.

The furnace vessel is indicated as having a lower portion or hearth 1 and a cylindrical side wall 2 which extends upwardly from the hearth, a removable cover 3 covering the top of the vessel. Although not shown, the vessel would normally have an outer steel shell with the portions 1 and 2 forming a non-magnetic, refractory lining. The lower portion 1, or hearth, contains the metal charge 5 which, in FIG. 1, is shown as a melt 4.

A cantilever arm 5 is shown as suspending two arcing electrodes 29 and 30 through suitable openings in the cover 3, keeping in mind that the number of electrodes is unimportant with respect to the present description.

To illustrate the present invention, the arcing electrode 29 is shown as forming an arc **29*a* between its bottom tip and the melt 4 with arrows indicating the arc-flare radiating towards an adjacent portion of the inside of the furnace lining 2. The ferro-magnetic particle feeder is shown at 31 with the particles falling to form a layer as at 32, the furnace lining being thinned so that a recess is formed on its outside, a water-cooled plate 33** being provided as in the Hanas et al. patent.

The new magnet construction of the present invention is shown as comprising an iron core formed by an upstanding or vertical yoke 34 from which three vertically interspaced pole pieces 35, 36 and 37 extend towards the side wall's portion to be protected against the arc-flare on its inside. A first solenoid coil **35*a* is coiled around the upper pole piece 35, and a second solenoid coil 38 is coiled around the yoke 34 between the interposed pole piece 36 and the lower pole piece 37. In other words, the new electromagnet consists of an E-shaped iron core formed by the rear yoke 34 and the three legs or pole pieces 35, 36 and 37 projecting forwards towards the furnace, and at least two solenoid coils, one being coiled around the upper leg or pole piece 25, and the other being coiled around the yoke 34, preferably as just described, namely between the pole pieces 36 and 37. With this new magnet construction, positioned with the faces of its pole pieces as close to the outside of the thinned-wall portion of the vessel core 2, as is permitted by the cooling plate or box 33, a flux field is obtained on the inside of the wall which is of substantially uniform intensity or strength throughout the entire vertical area embraced by the vertical extent of the magnet. Therefore, the layer of particles 32** which adheres to the inside of the furnace wall subjected to the arc-flare, is substantially uniform in thickness throughout. Throughout that area the furnace wall is protected. The solenoids are, of course, supplied with direct current, and because of their arrangement, the size of the magnet can be increased without loss of field strength in localized parts due to the relatively great interspacing of the pole pieces required by a larger electromagnet. Due to the effects previously described, a certain degree of the teardrop forms of particles, is possible, but with this new arrangement these forms substantially overlap each other so that no part of the furnace wall is directly exposed to the arc-flare throughout the vertical extent of the magnetic field provided.

Figure 5:
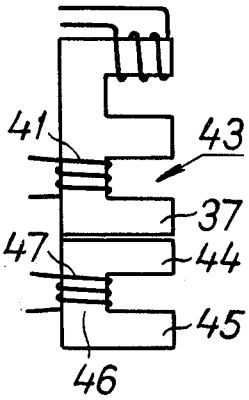
FIG. 5 schematically shows electromagnet constructions according to the principles of the present invention.

To increase the vertical extent of the magnetic field, FIG. 5 shows how a second electromagnet can be used. In this instance the electromagnet, according to the present invention, is shown at 43, it being downwardly extended by a magnet having a core formed by a yoke 46 from which two vertically interspaced pole pieces 44 and 45 extend forwardly, with the upper pole piece 44 positioned close to or in contact with the lower pole piece 37 of the magnet 43. This second or lower magnet has a solenoid coil 47 coiled around its yoke 46 between its two pole pieces. The result is a composite magnet of considerable vertical length but providing the uniform flux field on the inside of the furnace wall, and this arrangement can be extended by using more of the lower magnets, one below the other, all, of course, powered by direct current.

In the case of the magnet construction shown by FIG. 5, the solenoids should be coiled, or the direction of the current controlled, so that the upper and lower pole pieces are of the same polarity while the interposed pole pieces are of opposite polarity, and in the case of the FIG. 5 arrangement, the polarity of the poles 37 and 44 should be the same.

Figure 6:
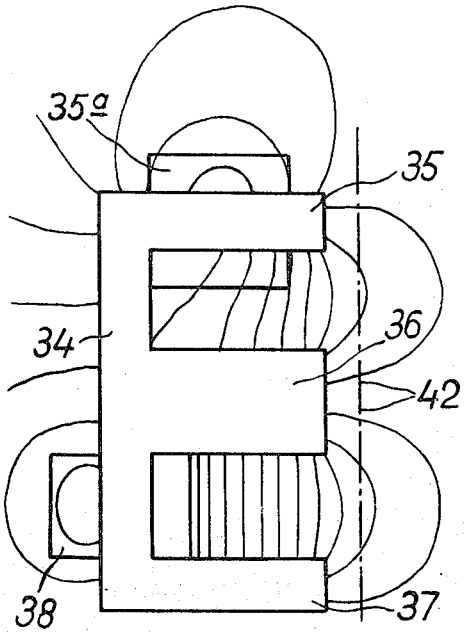
FIG. 6 is like FIG. 4 but shows the improved flux field obtained in the case of the present invention.

In the case of the upper magnet 43 of FIG. 5, this applying also to the magnet construction shown by FIG. 1, the field obtained is illustrated by FIG. 6 where it can be seen how the solenoid coils 35a and 38, in conjunction with the core construction described, provides a field that is approximately as strong throughout as at the three pole pieces 35, 36 and 37. As previously noted, a vertically complete layer of the magnetic particles is obtained.

Figure 7:
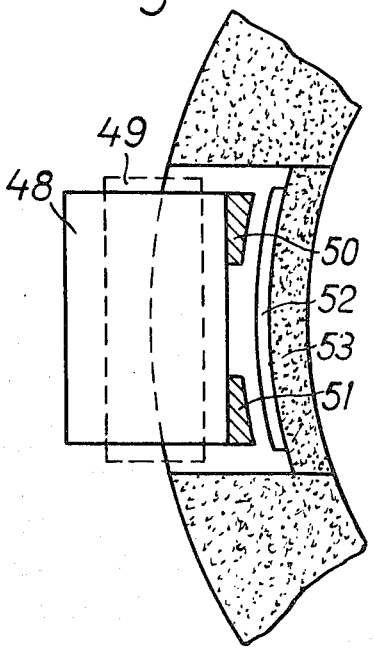
FIG. 7 is a horizontal section showing a modified form of the present invention.

In FIG. 7, the uppermost one of the three pole pieces of the new magnet is indicated at 48, its solenoid coil being indicated at 49 by broken lines. Here it can be seen that the front end of the pole piece is provided with pole piece extensions 50 and 51 having front faces following the contour of the necessarily curved cooling plate or box 52 which, in its turn, must follow the cylindrical contour of the thinned-wall portion 53 of the furnace lining. In this way an approximately even air gap distance between the pole piece and the inside wall of the furnace lining, can be obtained. It is, of course, to be understood, that all the other pole pieces would be similarly provided with such extensions. Alternately, the inner end faces of the pole pieces can be appropriately contoured to follow the contour of the cooling box and furnace lining.

It is to be understood that the water-cooled plate or cooling box should be made of non-magnetic metal and that assuming the refractory lining and hearth of the furnace vessel are encased by the usual steel shell, that a cut-out in this shell should be made at the recess in which the pole piece ends of the new magnet are positioned. Also, of course, a number of the new magnets with appropriate feeds for the magnetic particles, can be arranged around the furnace periphery, particularly at the point or points where the arc flare or flares are apt to do the most damage to the furnace lining, keeping in mind that many electric arc furnaces use more than one electrode, each producing its own arc-flare.

What is claimed is:

1. An electric arc furnace comprising at least one electrode having an end forming an arc producing an arc flare, a furnace side wall lining having at least one portion having an inside positioned to be radiated by said flare, said portion having an outside, a magnet on said outside forming a magnetic flux field which on said inside holds magnetic particles until the particles are heated to non-magnetic temperatures, and a feeder for feeding said field with replacement magnetic particles; wherein the improvement comprises said magnet being an electromagnet comprising a core formed by an upstanding yoke from which at least three pole pieces extend towards the side wall's said outside, said pole pieces being interspaced one above another and forming upper, lower and interposed pole pieces, a first solenoid coil coiled around said upper pole piece, and a second solenoid coil coiled around said core at a position below said interposed pole piece.

2. The furnace of claim 1 in which said second solenoid coil is coiled around said yoke between said interposed and lower pole pieces.

3. The furnace of claim 1 in which at least a second electromagnetic is positioned below the first-named electromagnet, said second electromagnet comprising an upstanding yoke having a solenoid coil coiled therearound, and upper and lower pole pieces extending from the just-named yoke respectively above and below the just-named solenoid coil, towards the side wall's said outside, the second electromagnet's said upper pole piece being at least adjacent to the first-named electromagnet's said lower leg.

4. The furnace of claim 1 in which the side wall's said portion is rounded and the said pole pieces have inner ends which are also rounded to substantially follow the contour of said portion.

5. The furnace of claim 1 in which said portion is of less thickness than other portions of said side wall, and a cooling plate is interposed between said magnet and said outside.

* * * * *